US006997889B1

(12) United States Patent
Thomas

(10) Patent No.: US 6,997,889 B1
(45) Date of Patent: Feb. 14, 2006

(54) ELECTRIC MASSAGE COMB

(76) Inventor: Torris G. Thomas, 301 14th Court North West, Birmingham, AL (US) 35215

( * ) Notice: Subject to any disclaimer, the term of this patent is extended or adjusted under 35 U.S.C. 154(b) by 401 days.

(21) Appl. No.: 10/317,407

(22) Filed: Dec. 11, 2002

(51) Int. Cl.
*A61H 7/00* (2006.01)

(52) U.S. Cl. ..... 601/137; 132/119.1

(58) Field of Classification Search ..... 132/119.1, 132/161, 141, 142, 148, 271, 322, 152; 601/70, 601/72, 73, 95; 15/22.2, 5
See application file for complete search history.

(56) References Cited

U.S. PATENT DOCUMENTS

| | | | | | |
|---|---|---|---|---|---|
| 955,339 | A | * | 4/1910 | Lumsden | 601/73 |
| 2,479,253 | A | * | 8/1949 | Predigev | 601/103 |
| 2,676,347 | A | * | 4/1954 | Hershey | 15/22.2 |
| 3,272,023 | A | * | 9/1966 | Ferguson et al. | 74/55 |
| 3,421,522 | A | * | 1/1969 | Magguilli | 132/119.1 |
| 3,782,395 | A | * | 1/1974 | Sarna | 132/212 |
| 3,840,030 | A | * | 10/1974 | Baker | 132/118 |
| 3,850,180 | A | * | 11/1974 | Ryckman et al. | 132/112 |
| 3,870,056 | A | * | 3/1975 | Stemme | 132/119.1 |
| 4,139,014 | A | * | 2/1979 | Rowland | 132/118 |
| D251,826 | S | * | 5/1979 | Hartung | D9/718 |
| 4,292,986 | A | * | 10/1981 | Ergaver et al. | 132/118 |
| 6,283,930 | B1 | * | 9/2001 | Purvis et al. | 601/137 |

* cited by examiner

*Primary Examiner*—Todd E. Manahan

(57) ABSTRACT

The electric massage comb is a handheld electrical tool that can be used to thoroughly scratch the scalp area or to provide a soothing massage for the scalp. This device would feature a tool similar in shape to a curling iron with rows of massaging bumps on the top side and rows of comb teeth on the bottom side. The comb teeth would be arranged in three rows, each row of teeth having a different height than the other rows. The teeth in each row would be arranged similarly to teeth on a standard comb. The handle of the electric massage comb would contain a motor assembly capable of producing longitudinal and axial motions. A variable speed switch would be located on the exterior of the handle and would enable the user to activate the massage comb and select one of three speeds for both the massaging and scratching motions of the device.

20 Claims, 3 Drawing Sheets

ELECTRIC MASSAGE COMB

BACKGROUND OF THE INVENTION

1. Field of the Invention

The present invention relates to a personal accessory for use in connection with massaging or scratching a person's scalp. The electric massage comb has particular utility in connection massaging and scratching a person's scalp through thick or thin hare, thereby providing relief from itchiness, a thorough massage, and scalp stimulation for the owner.

2. Description of the Prior Art

There are many different types of hair care shampoos and conditioning products, along with powered devices available for grooming, conditioning and styling a person's hair. While these products are well suited for treating and grooming the individual's hair, few if any, help stimulate or massage the scalp. Typically, electrical body massagers are not suitable for messaging the scalp because they are unable to penetrate the hair layer. The inability for body massagers to penetrate the hair layer is especially true for individuals with thick or thickly styled hair. Furthermore, the body massagers may not fulfill the user's need to scratch the scalp area. Additionally, the use of a body massager or hair care product to stimulate or massage the scalp requires the user to completely re-style or comb the hair again. This is a time consuming step and is an unacceptable procedure for many people who would like to massage or scratch the scalp area. Therefore, a device that could massage and scratch the scalp area without complete disruption of the hairstyle would be beneficial to many individuals.

The use of electric combs is known in the prior art. For example, U.S. Pat. No. 5,915,391 to Claude Revil discloses an electric comb for combing out and styling thick or difficult hair. While the Revil '391 patent is well suited for combing thick or difficult hair, it does not address several important factors for massaging or scratching the scalp area. First, the single line of teeth provided by the Revil '391 patent does not cover enough area on the scalp to thoroughly massage or scratch the scalp. Second, the Revil '391 patent makes no provision for variable speed for the comb teeth motion. A single speed might not serve users with varying scalp stimulation needs and may not suitably massage or scratch the scalp area. Finally, the Revil '391 patent does not provide teeth at different heights or levels, requiring the user to constantly adjust the position of the comb in order to reach the rounded portions of a person scalp.

U.S. Pat. No. 3,384,096 to Anthony Paccione discloses a teasing comb apparatus with oscillating teeth members supported by a frame. However, since the Paccione '096 device oscillates in only one direction, it would not be as effective for massaging the scalp as comb teeth that oscillate in multiple directions. Furthermore, the Paccione '096 patent places all the teeth at the same level, making it cumbersome and ineffective on the rounded portions of the scalp. Lastly, the Paccione '096 patent only provides for a single speed of oscillation of the comb's teeth, which would not provide effective massage and relief from scalp itches for all users.

Similarly, U.S. Pat. No. Des 207,690 to Leonard R. Marsano discloses the ornamental design for a comb and handle apparatus with an elongated hook for curling purposes located above the comb portion. However, the Marsano '690 patent does not discuss how, and in what direction, the comb would oscillate. Additionally, the Marsano '690 device provides only a single row of teeth for the comb, which would not satisfactorily massage the entirety of a person's scalp, especially on the rounded portions of the human scalp. Finally, the Marsano '690 patent does not indicate how the device would operate with a motor or if the motor would contain variable speed adjustments. Again, the ability to adjust the speed of the action of the comb's teeth is critical in providing multiple forms of scalp relief to variety of users.

U.S. Pat. No. 5,343,881 to Zeev Golan, Ruth Golan, Shlomo Gilboa and Liora Gilboa disclose an apparatus for the treatment of hair, generally comprising a handle and a plurality of teeth oscillating at a length of no greater than 8 millimeters and a frequency of no less than 3000 cycles per minute. However, the Golan, et al. '881 device would not be effective for massaging or scratching the scalp because it only oscillates in one direction. Because comb teeth that oscillate in multiple directions will enhance the massaging and scratching results, the Golan, et al. '881 patent would not satisfy the user's requirement to massage the scalp area thoroughly. Furthermore, the Golan, et al. '881 patent places all the teeth at the same level, making it cumbersome and ineffective on the rounded portions of the scalp.

Likewise, U.S. Pat. No. 2,895,487 to Lillian Hazzard discloses a comb like device that is used for cleaning the hair and scalp. The Hazzard '487 patent uses an exchangeable absorbent material in between the teeth of the comb in order to remove moisture, oil and dirt from the hair. However, the Hazzard '487 patent does not address a method for automating the movement of the teeth, in order to prevent fatigue of the user. Additionally, the Hazzard '487 device requires the user to constantly update or replace the moisture-absorbing pad in the comb, which can waste time and add unwanted expense for the user. Finally, the Hazzard '487 device is not suitable for prolonged scratching or massaging of the scalp because the teeth of the comb are the same length and distance from the base unit, making it difficult to scratch and message the rounded portions of the human head.

Lastly, U.S. Pat. No. 4,210,162 to Bernard F. Dreyer and Paul F. Paglericcio discloses a hair styling device with a chamber having air withdrawn in order to create a vacuum in the chamber itself. The vacuum chamber, surrounded by supplementary orifices supplying heated air, draws the user's hair into the chamber to assist in the drying process. While the Dreyer, et al. '162 patent is well suited for drying the user's hair, it is not intended to stimulate, scratch or touch the scalp of the user. Additionally, the Dreyer, et al. '162 patent makes no provision for the oscillatory function necessary for massaging or scratching areas of the scalp. Finally, the Dreyer, et al. '162 patent does not provide an apparatus such as comb teeth, to penetrate thick or styled hair by which the device can be used to reach the scalp.

While the above-described devices fulfill their respective, particular objectives and requirements, the aforementioned patents do not describe an electric massage comb that provides a thorough scalp massage, along with relief from itchiness, independent of the thickness of the user's hair. The single line of teeth provided by the Revil '391 and Marsano '690 patents does not cover enough area on the scalp to thoroughly massage or scratch the scalp. Furthermore, the Revil '391, Paccione '096, the Golan, et al. '881, and Hazzard '487 devices fail to provide comb teeth of varying heights, requiring the user to constantly adjust the position of the comb in order to reach the rounded portions of his scalp. In addition, the Paccione '096, Marsano '690, and Golan, et al. '881 devices do not provide oscillation in multiple directions, thus they would not provide as effective a means for massaging the scalp as a device with comb teeth that oscillate in multiple directions. Moreover, the Hazzard '487 and Dreyer, et al. '162 patents make no provision for the oscillatory motion necessary for providing effective massage therapy for the scalp, and the Marsano '690 patent makes no indication of how the device would operate with a motor or whether the motor would contain variable speed adjustments. The single speed for the comb teeth motion provided in the Revil '391 and Paccione '096 patents limits the effectiveness of these devices and might not provide effective massage and relief from scalp itches for all users. Additionally, the Hazzard '487 device would be time consuming and expensive to use since it requires constant replacement of the moisture-absorbing pad in the comb. Finally, the Dreyer, et al. '162 device would be ineffective in providing a scalp massage or relief from scalp itchiness since it has no apparatus, such as comb teeth, by which the device can be used to reach the scalp.

Therefore, a need exists for a new and improved electric massage comb that can be used for providing relief from an itchy scalp and a thorough scalp massage. In this regard, the present invention substantially fulfills this need. In this respect, an electric massage comb according to the present invention substantially departs from the conventional concepts and designs of the prior art, and in doing so, provides an apparatus primarily developed for the purpose of providing a soothing massage and relief from scalp itchiness without disturbing the user's hair style.

SUMMARY OF THE INVENTION

In view of the foregoing disadvantages inherent in the known types of electric combs now present in the prior art, the present invention provides an improved electric massage comb, and overcomes the above-mentioned disadvantages and drawbacks of the prior art. As such, the general purpose of the present invention, which will be described subsequently in greater detail, is to provide a new and improved electric massage comb and method which has all the advantages of the prior art mentioned heretofore and many novel features that result in an electric massage comb which is not anticipated, rendered obvious, suggested, or even implied by the prior art, either alone or in any combination thereof.

To attain this, the present invention essentially comprises a handle containing a motor, a longitudinal motion assembly, and a rotational motion assembly which induce movement in a comb shaft that has massage bumps located on the top side and comb teeth extending from the bottom side.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electric massage comb that has all of the advantages of the prior art electric combs and none of the disadvantages.

It is another object of the present invention to provide a new and improved electric massage comb that may be easily and efficiently manufactured and marketed.

An even further object of the present invention is to provide a new and improved electric massage comb that has a low cost of manufacture with regard to both materials and labor, and which accordingly is then susceptible of low prices of sale to the consuming public, thereby making such an electric massage comb economically available to the buying public.

Still another object of the present invention is to provide a new electric massage comb that provides in the apparatuses and methods of the prior art some of the advantages thereof, while simultaneously overcoming some of the disadvantages normally associated therewith.

Even still another object of the present invention is to provide an electric massage comb for massaging the user's scalp. This allows the user to enjoy a relaxing scalp massage without the aid of another person.

Yet another object of the present invention is to provide an electric massage comb that produces both a longitudinal and an axial motion. This provides a more invigorating scalp massage than a unilateral movement, possibly improving circulation in the process.

Still yet another object of the present invention is to provide an electric massage comb for scratching the user's scalp. This allows the user to safely relieve an itchy scalp without causing abrasions to the scalp with sharp fingernails.

Even yet another object of the present invention is to provide an electric massage comb that provides variable length comb teeth. This allows the user to reach his scalp through any thickness of hair without disturbing a preestablished hair style.

Lastly, it is an object of the present invention to provide a new and improved electric massage comb for providing soothing scalp massages and relief from an itchy scalp. This allows the user to attend to a variety of needs for his scalp without experiencing fatigue of his hands and arms.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
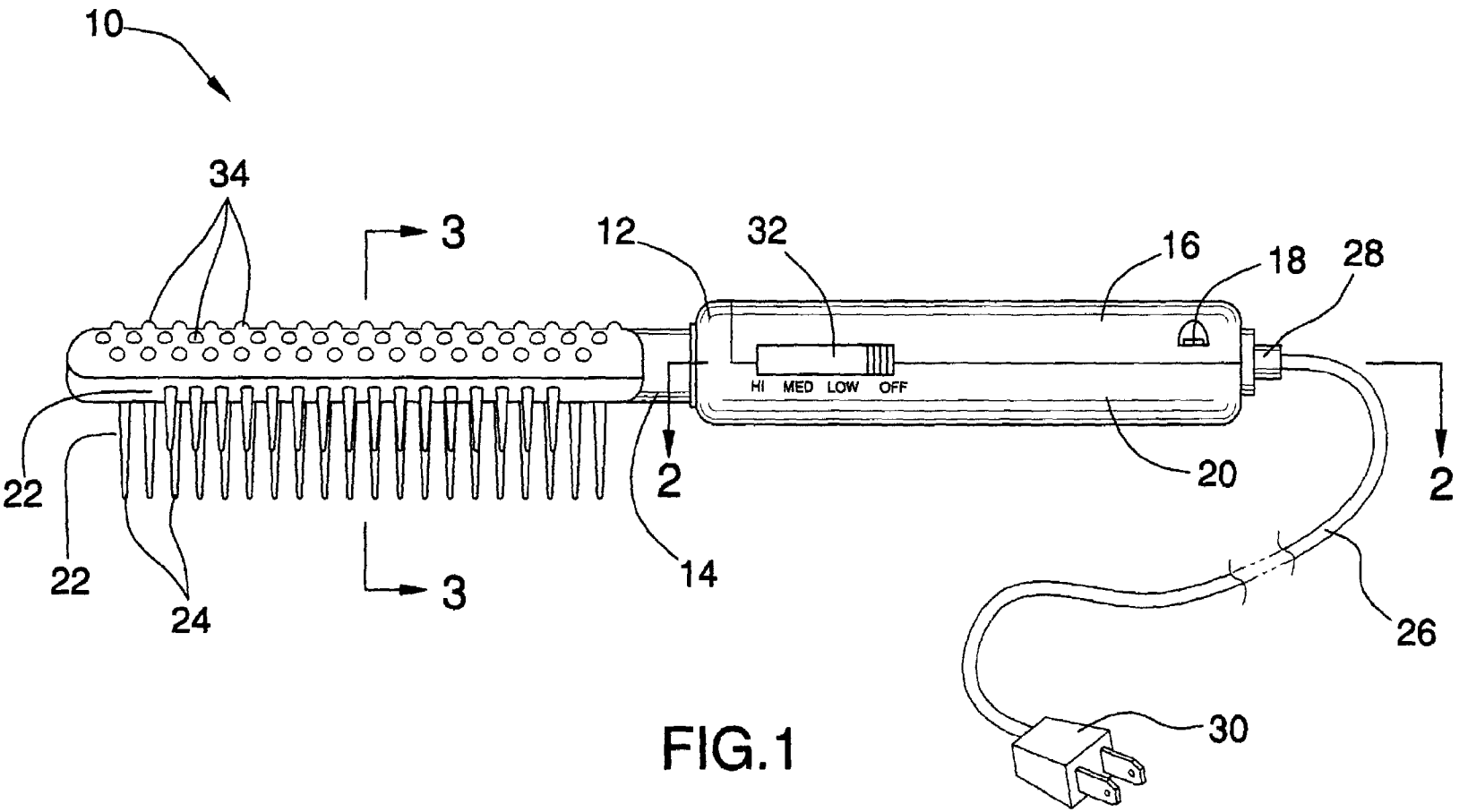
FIG. 1 is a side view of the preferred embodiment of the electric massage comb constructed in accordance with the principles of the present invention.
Figure 2:
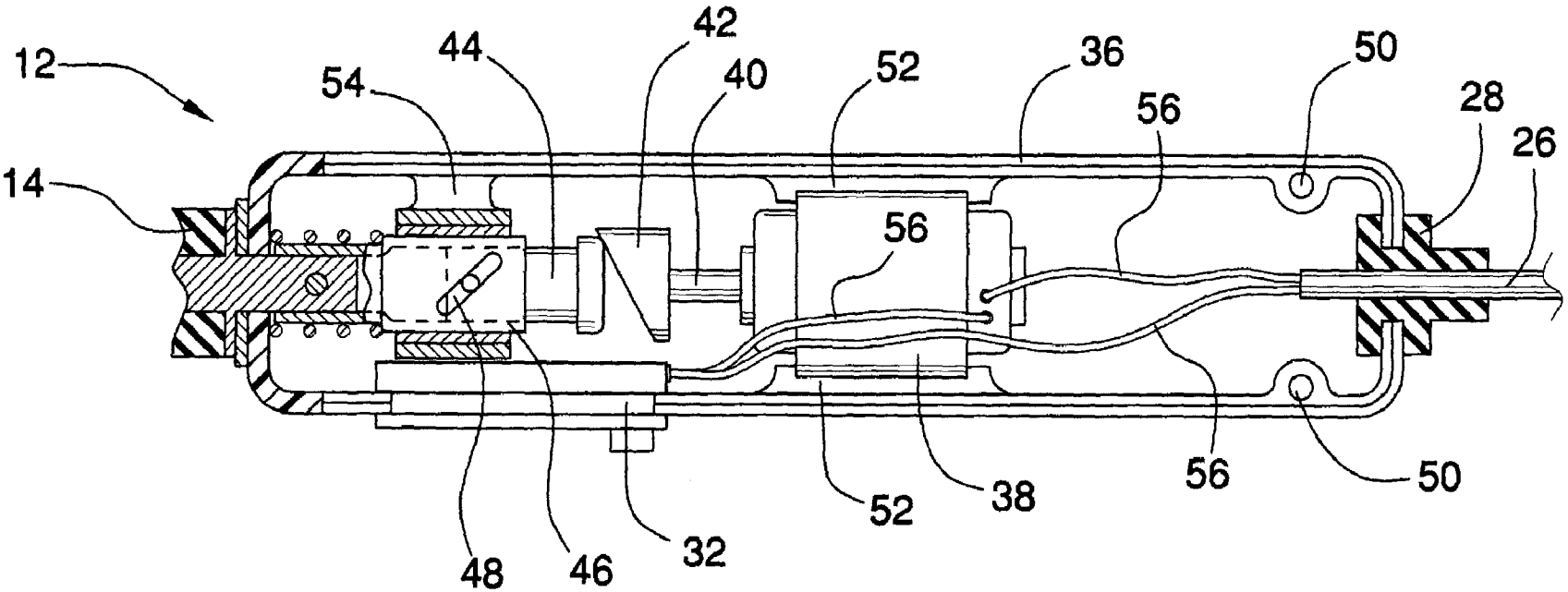
FIG. 2 is a top sectional view of the handle of the electric massage comb of the present invention taken along a longitudinal axis.
Figure 3:
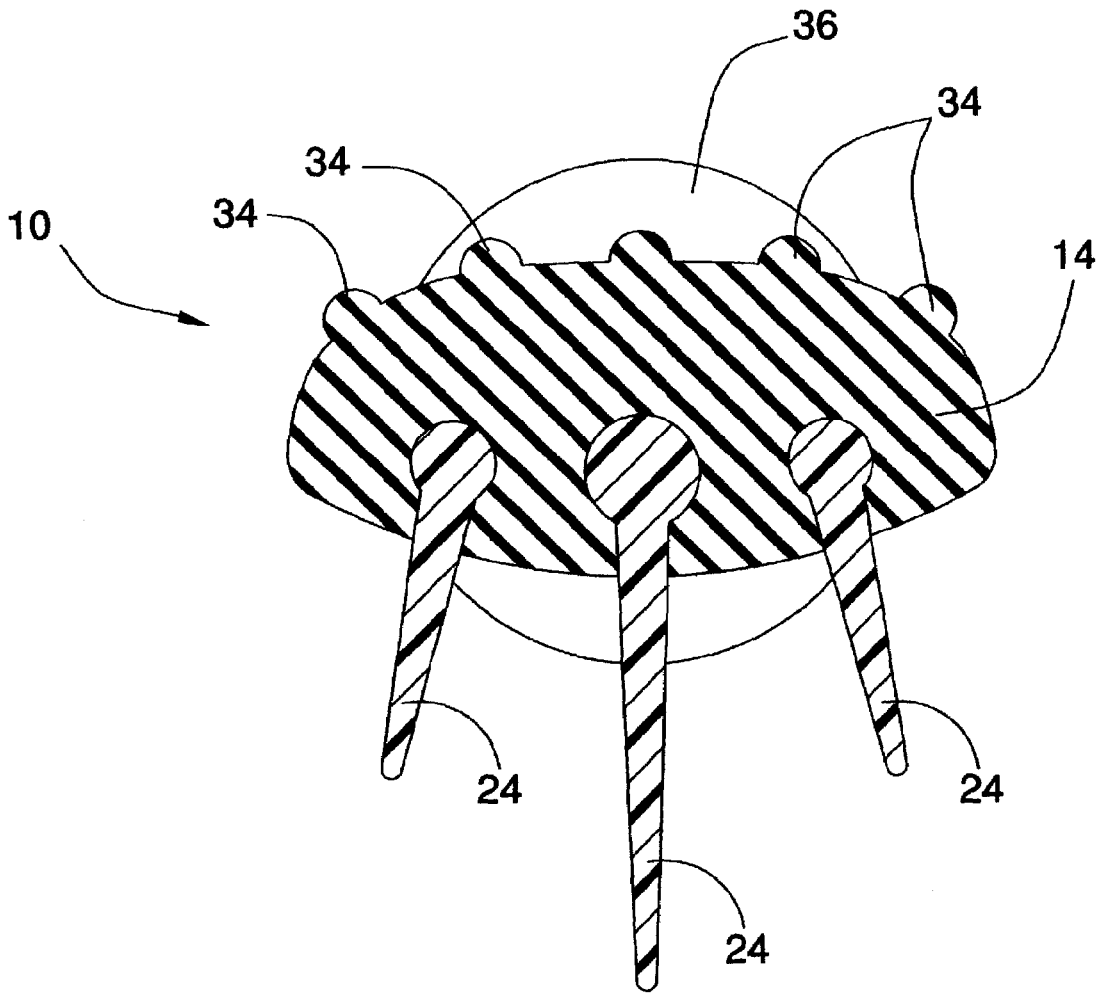
FIG. 3 is a front sectional view of the electric massage comb of the present invention taken on a radial axis.

Referring now to the drawings, and particularly to FIGS. 1–3, a preferred embodiment of an electric massage comb of the present invention is shown and generally designated by the reference numeral 10.

In FIG. 1, a new and improved electric massage comb 10 of the present invention for providing scalp massage and relief from an itchy scalp is illustrated and will be described. More particularly, the electric massage comb 10 has a cylindrical handle 12 with a comb shaft 14 extending from it. The handle 12 has a removable top portion 16 accessed by removing the screws 18 securing it to the bottom portion 20. The comb shaft 14 features two combs 22, each of which consists of a row of teeth 24. The term comb 22 refers to the longitudinal rows of teeth 24 present on the shaft. The handle 12 has an electrical cord 26 extending from one end through the center of a circular cord support 28. The cord support 28 helps prevent undue stress on the cord 26 at its point of connection with the handle 12. The opposite end of the cord 26 features a standard electrical plug 30. Those skilled in the art will recognize that the cord 26 and its support 28 may be obviated via the use of an alternative power source, such as a battery, to allow a cordless model of the invention. A variable speed control switch 32 is located along the column of the handle 12. The speed control switch 32 features off, low, medium, and high settings and adjusts the speed of the combs 22 as well as that of the teeth 24. The comb shaft 14 has two combs 22, each having a different height. Each comb 22 is between 3 and 4 inches long, with teeth 24 spaced approximately 3/16 inch apart. The height of the teeth 24 varies from 1 to 4 inches, with all of the teeth 24 associated with a comb 22 having the same height. Rows of raised bumps 34 are located along the rest of the comb shaft 14 for use in scalp massage. The electric massage comb 10 provides two separate motions. The first motion is longitudinal and parallel to the comb shaft 14, causing the combs 22 to move up and down along the shaft. The second motion is radial and perpendicular to the comb shaft 14 causing the teeth 24 to move back and forth in a rotational motion.

FIG. 2 shows a top sectional view of the handle 12 of the electric massage comb 10 taken along the longitudinal axis. The handle 12 features a plastic cylindrical housing 36 encasing a motor 38, a rotational shaft 40, a reciprocating cam 42, a sliding shaft 44 with an associated bushing 46, and an oscillating cam 48. The bottom portion 20 of the handle 12 features two screw apertures 50 for securing the top portion 20 of the handle, two motor supports 52, and a bushing support 54 for providing stability to the various internal parts of the handle 12. The electrical cord 26 passes through the cord support 28 before branching into separate wires 56 which are connected to the motor 38 and the variable speed switch 32. The variable speed switch 32 controls the speed at which the motor 38 turns the rotational shaft 40. The reciprocating cam 42 is cylindrical with an angled end presented to the sliding shaft 44. As the reciprocating cam 42 turns, the sliding shaft 44 will move to the right and left through the bushing 46, depending on the position of the angled portion of the reciprocating cam 42. As the sliding shaft 44 moves left and right, the oscillating cam 48 is responsible for moving the sliding shaft 44 in a radial direction. This, in turn, drives the comb shaft 14 in a rotational manner, as well. Thus, both longitudinal and radial movements are experienced by the comb shaft 14.

FIG. 3 shows a front sectional view of the electric massage comb 10 taken along a radial axis. The comb shaft 14 has an elliptical shape, with the elongated axis positioned in the horizontal direction. A multitude of bumps 34 are situated on the top side of the comb shaft 14, and combs 22 and associated teeth 24 are located on the bottom side. The teeth 24 project through openings in the comb shaft 14.

The electric massage comb is a new tool for massaging the scalp and providing relief from scalp itch. The comb would be produced from plastic components and would feature a variable speed control switch with four speed settings, off, low, medium, and high. One side of the comb shaft would feature two rows of teeth, with each row having a different height, and could be used for relief from an itchy scalp. The teeth would allow the user to reach his scalp through any thickness of hair without damaging a hair style. The other side of the shaft would feature rows of bumps which could be used for a soothing scalp massage.

For use, the individual would plug in the electric massage comb, select the desired speed and move the switch to the appropriate location, and place either the teeth or the bumps against the scalp. The teeth could be used to scratch the scalp, and the bumps could be used to massage the scalp. The user would then hold the massage comb against his scalp until the desired results were obtained. At this time, the user would remove the massage comb from his scalp, turn it off, and unplug it.

The electric massage comb is appealing due to its multifunctional design, ease of use, convenience, compact size, light weight, portability, and effectiveness, This specially designed comb would provide a stimulating massage for the scalp, and could possible improve circulation. It would allow an individual to enjoy a deep scalp massage with minimal effort and without the help of another person. This product would also serve as a timesaving alternative to traditional methods of scratching the scalp, such as using the fingers or a conventional comb.

While a preferred embodiment of an electric massage comb has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, PVC, or a variety of wood may be used instead of the plastic handle described. Also, the teeth of the combs could be made of plastic, heavy duty rubber, or a similar, slightly flexibly material. And although scratching and massaging the scalp have been described, it should be appreciated that the electric massage comb herein described is also suitable for scratching and massaging other body parts such as the neck, back, shoulders, feet, calves, and the like.

Therefore, the foregoing is considered as illustrative only of the principles of the invention. Further, since numerous modifications and changes will readily occur to those skilled in the art, it is not desired to limit the invention to the exact construction and operation shown described, and accordingly, all suitable modifications and equivalents may be resorted to, falling within the scope of the invention.

I claim:

1. An electric massage comb comprising:

a hollow handle having a first end formed with a longitudinal aperture, a second end formed with a longitudinal aperture, an interior surface, and an exterior surface;

an electrical cord having a first end and a second end and connected on said first end to said handle wherein said electrical cord passes through said longitudinal aperture in said first end of said handle;

an electrical plug connected to said second end of said electrical cord;

a variable speed control switch connected to said exterior surface of said handle;

a first electrical wire connecting said electrical cord to said variable speed control switch;

a motor assembly capable of simultaneously producing a rotational and a sliding motion and connected to said interior surface of said handle;

a second electrical wire connecting said motor assembly to said electrical cord;

a third electrical wire connecting said motor assembly to said speed control switch;

a comb shaft connected to said handle and said motor assembly, wherein said motor assembly drives said comb shaft in both longitudinal and radial movements simultaneously;

a massaging apparatus connected to said comb shaft; and a scratching apparatus connected to said comb shaft.

2. The electric massage comb of claim 1 further comprising:

a cord support having a cylindrical main body with a first end, a second end, and an external surface and formed with a longitudinal aperture along the longitudinal axis of said main body, a slot traversing the external surface along a line defining the diameter of said main body and on a plane bisecting said longitudinal axis of said main body, and a cylindrical extension protruding from said first end of said main body and sharing said longitudinal axis of said main body and formed with a longitudinal aperture along said longitudinal axis and connected to said electrical cord wherein said cord passes through said longitudinal axis of said extension and through said longitudinal axis of said main body and connected to said first end of said handle wherein said slot of said main body fits into said longitudinal aperture of said first end of said handle with said second end of said main body residing inside said handle and said first end of said main body and said cylindrical extension residing outside said handle.

3. The electric massage comb of claim 1 wherein said motor assembly further comprises:

a motor;

a drive shaft having a first end and a second end and connected to said motor on said first end wherein said motor rotates said drive shaft;

a reciprocal cam having a flat first end and a diagonally angled second end and connected on said first end to said drive shaft wherein said reciprocal cam rotates as said drive shaft rotates;

a cylindrical sliding shaft having a first end and a second end and connected on said first end to said second end of said reciprocal shaft wherein said first end of said shaft rests against that portion of said second end of said reciprocal cam which is presented as said reciprocal cam rotates on said drive shaft causing said sliding shaft to slide back and forth;

a bushing having a first end and a second end and formed with a cylindrical longitudinal aperture from said first end to said second end with a diameter slightly larger than that of said sliding shaft and connected to said sliding shaft wherein said sliding shaft passes through said longitudinal aperture; and an oscillating cam connected to said sliding shaft wherein said oscillating cam causes said sliding shaft to rotate along its radial axis.

4. The electric massage comb of claim 3 wherein said comb shaft is connected to said second end of said sliding shaft wherein said sliding shaft is capable of moving said comb shaft in the rotational and sliding motions simultaneously imposed upon said sliding shaft.

5. The electric massage comb of claim 4 wherein said handle further comprises:

a bottom half having a right side and a left side and formed with a pair of motor supports to wedge said motor securely in said bottom half of said handle, a bushing support to wedge said bushing securely in said bottom half of said handle, a comb shaft support, a first screw aperture in said right side, and a second screw aperture in said left side wherein said first screw aperture lines up on a radial axis with said second screw aperture;

a top half having a right side formed with an indentation having a flat bottom with a screw aperture lining up with said screw aperture in said right side of said bottom half and a left side formed with an indentation having a flat bottom with a screw aperture lining up with said screw aperture in said left side of said bottom half and removably connected to said bottom half;

a first screw connected to said top half and said bottom half of said handle wherein said screw passes through said screw aperture in said right side of said top half and is inserted into said screw aperture of said right side of said bottom half; and a second screw connected to said top half and said bottom half of said handle wherein said screw passes through said screw aperture in said left side of said top half and is inserted into said screw aperture of said left side of said bottom half.

6. The electric massage comb of claim 5 wherein said comb shaft has a top surface and a bottom surface formed with a plurality of transverse apertures formed into a first, a second, and a third longitudinal row, is elongated and hollow, and has an approximately elliptical shape.

7. The electric massage comb of claim 6 wherein said massaging apparatus further comprises:

a plurality of bumps connected to said top surface of said comb shaft.

8. The electric massage comb of claim 6 wherein said scratching apparatus further comprises:

a first plurality of comb teeth connected to said top surface of said comb shaft wherein said teeth project through said first row of said transverse apertures;

a second plurality of comb teeth having a different length than said first plurality of comb teeth and connected to said top surface of said comb shaft wherein said teeth project through said second row of said transverse apertures; and a third plurality of comb teeth having a different length than said first or said second plurality of comb teeth and connected to said top surface of said comb shaft wherein said teeth project through said third row of said transverse apertures.

9. The electric massage comb of claim 1 wherein said variable speed control switch has a plurality of positions such that when said position of said variable speed control switch is changed, said motor assembly will operate at a different speed for each said position.

10. The electric massage comb of claim 9 wherein one said position of said variable speed control switch deactivates said motor assembly.

11. The electric massage comb of claim 1 wherein said longitudinal motion apparatus comprises:

a reciprocal cam having a flat first end and a diagonally angled second end and connected on said first end to said drive shaft wherein said reciprocal cam rotates as said drive shaft rotates;

a cylindrical sliding shaft having a first end and a second end and connected on said first end to said second end of said reciprocal shaft wherein said first end of said shaft rests against that portion of said second end of said reciprocal cam which is presented as said reciprocal cam rotates on said drive shaft causing said sliding shaft to slide back and forth in a longitudinal direction; and a bushing having a first end and a second end and formed with a cylindrical longitudinal aperture from said first end to said second end with a diameter slightly larger than that of said sliding shaft and connected to said sliding shaft wherein said sliding shaft passes through said longitudinal aperture.

12. The electric massage comb of claim 11 wherein said axial motion apparatus comprises:

an oscillating cam connected to said sliding shaft wherein said oscillating cam causes said sliding shaft to rotate along its radial axis.

13. The electric massage comb of claim 12 wherein said comb shaft is connected to said second end of said sliding shaft wherein said sliding shaft is capable of moving said comb shaft in the longitudinal and radial motions simultaneously imposed upon said sliding shaft.

14. The electric massage comb of claim 13 wherein said handle further comprises:

a bottom half having a right side and a left side and formed with a pair of motor supports to wedge said motor securely in said bottom half of said handle, a bushing support to wedge said bushing securely in said bottom half of said handle, a comb shaft support, a first screw aperture in said right side, and a second screw aperture in said left side wherein said first screw aperture lines up on a radial axis with said second screw aperture;

a top half having a right side formed with an indentation having a flat bottom with a screw aperture lining up with said screw aperture in said right side of said bottom half and a left side formed with an indentation having a flat bottom with a screw aperture lining up with said screw aperture in said left side of said bottom half and removably connected to said bottom half;

a first screw connected to said top half and said bottom half of said handle wherein said screw passes through said screw aperture in said right side of said top half and is inserted into said screw aperture of said right side of said bottom half; and a second screw connected to said top half and said bottom half of said handle wherein said screw passes through said screw aperture in said left side of said top half and is inserted into said screw aperture of said left side of said bottom half.

15. The electric massage comb of claim 14 wherein said comb shaft has a top surface and a bottom surface formed with a plurality of transverse apertures formed into a first, a second, and a third longitudinal row, is elongated and hollow, and has an approximately elliptical shape.

16. The electric massage comb of claim 15 wherein said massaging apparatus further comprises:

a plurality of bumps connected to said top surface of said comb shaft.

17. The electric massage comb of claim 15 wherein said scratching apparatus further comprises:

a first plurality of comb teeth connected to said top surface of said comb shaft wherein said teeth project through said first row of said transverse apertures;

a second plurality of comb teeth having a different length than said first plurality of comb teeth and connected to said top surface of said comb shaft wherein said teeth project through said second row of said transverse apertures; and a third plurality of comb teeth having a different length than said first or said second plurality of comb teeth and connected to said top surface of said comb shaft wherein said teeth project through said third row of said transverse apertures.

18. An electric massage comb comprising:

a hollow handle having a first end formed with a longitudinal aperture, a second end formed with a longitudinal aperture, an interior surface, and an exterior surface;

a cord support having a first end and a second end and formed with a longitudinal aperture from said first end to said second end and connected to said first end of said handle wherein said longitudinal aperture is aligned with said longitudinal aperture of said first end of said handle;

an electrical cord having a first end and a second end and connected on said first end to said cord support wherein said first end of said electrical cord passes through said longitudinal aperture in said cord support;

an electrical plug connected to said second end of said electrical cord;

a variable speed control switch connected to said exterior surface of said handle;

a first electrical wire connecting said electrical cord to said variable speed control switch;

a motor connected to said interior surface of said handle;

a second electrical wire connecting said motor to said electrical cord;

a third electrical wire connecting said motor to said speed control switch;

a drive shaft having a first end and a second end and connected on said first end to said motor;

a longitudinal motion apparatus connected to said second end of said drive shaft;

an axial motion apparatus connected to said longitudinal motion apparatus;

a comb shaft connected to said longitudinal motion apparatus and said axial motion apparatus, wherein said longitudinal motion apparatus and said axial mot ion apparatus drive said comb shaft in both longitudinal and radial movements simultaneously;

a massaging apparatus connected to said comb shaft; and a scratching apparatus connected to said comb shaft.

19. The electric massage comb of claim 18 wherein said cord support has a cylindrical main body with a first end, a second end, and an external surface and formed with a longitudinal aperture along the longitudinal axis of said main body, a slot traversing the external surface along a line defining the diameter of said main body and on a plane bisecting said longitudinal axis of said main body, and a cylindrical extension protruding from said first end of said main body and sharing said longitudinal axis of said main body and formed with a longitudinal aperture along said longitudinal axis and connected to said electrical cord wherein said cord passes through said longitudinal axis of said extension and through said longitudinal axis of said main body and connected to said first end of said handle wherein said slot of said main body fits into said longitudinal aperture of said first end of said handle with said second end of said main body residing inside said handle and said first end of said main body and said cylindrical extension resides outside said handle.

20. The electric massage comb of claim 18 wherein said variable speed control switch has a plurality of positions such that when said position of said variable speed control switch is changed, said motor will operate at a different speed for each said position and wherein one said position deactivates, said motor.

* * * * *